United States Patent [19]

Forbes, Jr.

[11] Patent Number: 4,516,718

[45] Date of Patent: May 14, 1985

[54] CARTON WITH AUTOMATIC LOCK

[75] Inventor: Hampton E. Forbes, Jr., Wilmington, Del.

[73] Assignee: Westvaco Corporation, New York, N.Y.

[21] Appl. No.: 534,069

[22] Filed: Sep. 20, 1983

[51] Int. Cl.[3] ..... B65D 5/22

[52] U.S. Cl. ..... 229/33; 229/39 R; 229/43; 229/44 R; 229/45 R

[58] Field of Search ..... 229/33, 39 R, 43, 44 R, 229/45 R

[56] References Cited

U.S. PATENT DOCUMENTS 3,105,626 10/1963 McCormick et al. ..... 229/33
3,226,005 12/1965 Paige ..... 229/33
4,042,166 8/1977 Selin et al. ..... 229/33
4,232,816 11/1980 Johnson et al. ..... 229/33

*Primary Examiner*—Joseph Man-Fu Moy

[57] ABSTRACT

A carton for food products or the like comprises a combination lid and tray with an automatic locking means for securing the lid and tray when the carton is closed. The automatic locking means consists of one or more locking tongues integral with the tray component which engage one or more locking slots formed in the lid component. The locking tongues include locking posts and shoulders which become engaged behind locking tabs formed by the locking slot when the carton is closed. The locking tongues remain exposed above the top of the lid when the carton is closed where they may be readily removed or released to open the carton.

13 Claims, 14 Drawing Figures

11
13
42
43
51
42
41
43
35
34
48
49
46
25
12

34
11
34
51
41
12

34
42
43
14
48
49
11
12

CARTON WITH AUTOMATIC LOCK

BACKGROUND OF INVENTION

The present invention relates to a disposable carton for food products or the like and more particularly to a carton formed from lid and tray members which includes an automatic and positive locking means when the carton is closed.

The manufacture of disposable food cartons particularly for the fast food industry involves highly developed technology and competition. Such cartons must be designed for maximum economy and utility with emphasis on ease of handling, filling and closing, product identification, storage of unused cartons and integrity after being filled. When such cartons are used for packaging hot foods, special considerations must be incorporated into the carton design to vent the interior of the carton while still maintaining the packaged products hot. Moreover, since such cartons are used primarily in the fast food industry where speed in handling and packaging is required, there has existed for some time a clear need to provide such a carton with an effective automatic lock.

Various types of foam cartons have been designed and developed for packaging and serving hot foods. Examples of such cartons are shown in the following U.S. Pat. Nos. 3,767,110; 3,968,921; 3,977,595; and 4,383,638. Many of the cartons disclosed in these patents include locking means for the bottom and top members. However, none of the locking means are automatic since they require separate mechanical action or manipulation to insure a positive locking action. Moreover, such cartons are inferior to paperboard cartons in many ways including the inability to print sharp graphics on the outer surfaces thereof and their inherent disposability problems. Accordingly, paperboard cartons are preferred for many applications because of their versatility and economy. In this regard, U.S. Pat. Nos. 4,090,453 and 4,232,816 illustrate examples of paperboard cartons for use in the food industry. However, in each of the patented designs, the locking means for the cartons are not automatic but require a separate manual action for securing the tray and lid components together.

Meanwhile, it is also known from the more general prior art involving the manufacture and design of containers, that effective positive locking means have been used for closures in the past. Examples of such closures are shown in prior U.S. Pat. Nos. 2,190,433; 2,675,160; 3,037,684; and 3,064,877. In each of these patents, effective and positive locking means are disclosed for various containers intended for various uses. However, in each example, the closures cannot be automatically engaged, but require a separate mechanical action to align the locking elements together, or, one or more of the locking elements must be bent from its normal position before it can be utilized. Thus, even though a clear need has existed in the fast food industry for a carton with an effective, positive, automatic locking means upon closure, it has not been obvious to any of the proir workers in the field to design such a package.

SUMMARY OF INVENTION

Specifically, the carton of the present invention comprises a pair of space defining members in the form of a lid and tray which may be locked together in their closed condition by an automatically engaged positive lock. For this purpose, each tray component contains at least one locking tongue element connected to a tray side wall which extends upwardly therefrom in the same general plane as the side wall. Meanwhile, each lid component contains at least one locking slot, which cooperates with the locking tongue element on the tray component, formed as a continuous cut line which lies partly in the top panel portion of the lid and partly in an adjacent side wall of the lid closely adjacent to a score line between the top panel and side wall. The tongue element is constructed so as to have a pair of shoulder portions while the locking slot is cut so as to form a pair of cooperating locking tabs. When the lid component and tray component are brought together to close the carton, the tongue element is automatically guided into the locking slot where the shoulder portions of the tongue are wedged around and become secured behind the locking tabs of the locking slot. This action provides a positive lock for the lid and tray components so that the components cannot be opened without employing a separate step to release the tongue from the slot. For this purpose, the tongue element may be provided with a perforated tear line located in the region of its shoulder portions or the adjacent side wall may be provided with a removable, tear out part for freeing the tongue element.

The tray and lid components may be made integral and cut from a single blank of paperboard or the like, or each component may be formed separately. In addition, the side walls of the tray and lid are preferably oriented so as to taper outwardly from their respective bottom and top panels. This orientation of the side walls provides a means for guiding the tongue element into its corresponding slot. In some instances, depending upon the shape and size of the carton, it may be desirable to provide the carton components with two or more cooperating locking elements. Where the carton components are prepared from two separate blanks, at least two tongue elements and locking slots are required for each component, preferably located on opposed side walls.

In general, the upper edges of the side walls of the tray component are designed to be fully telescoped by the side walls of the lid component. However, in the one piece cartons where the lid component is fashioned from an extension of a side wall of the tray component, only the remaining side walls are telescoped by the lid. However, each side wall of the tray component does not have to be the same height. It is only necessary that the side wall containing the locking tab element be of a height so that it will abut against the top panel of the lid component when the carton is closed. Meanwhile, in the two piece cartons only the opposed side walls containing the upstanding locking tongue elements are required to be of a height so that they abut against the top panel of the cooperating lid. The other side walls may be reduced slightly in height to provide appropriate venting of the interior of the carton when packaging hot foods.

The locking components of the carton disclosed herein operate from the inside to the outside. That is, the locking tongue is inserted into its locking slot from the inside of the lid so that the locking tongue extends above and outside the lid when the carton is closed. This arrangement provides easy access to the locking tongue element when it is desired to open the carton. In addition, this arrangement in conjunction with the tapered side walls of the lid and tray provides an effective alignment action between the locking elements to achieve a positive, automatic lock.

It is thus a general object of the present invention to provide a self locking food carton prepared from one or more blanks of paperboard or the like, and which is constructed so that when it is filled, closed and locked, it is unlikely to be accidentally opened upon careless handling.

A more specific object of the present invention is to provide an automatic locking means for a two part carton wherein the locking tongue is automatically guided into its locking slot where the locking elements become automatically engaged with one another without additional manual adjustment or manipulation.

The foregoing statements are indicative in a general way of the nature and scope of the present invention. Other and more specific advantages will be apparent to those skilled in the art upon a full understanding of the construction and operation of the improved carton and its locking features disclosed more fully hereinafter.

DETAILED DESCRIPTION

Figure 1:
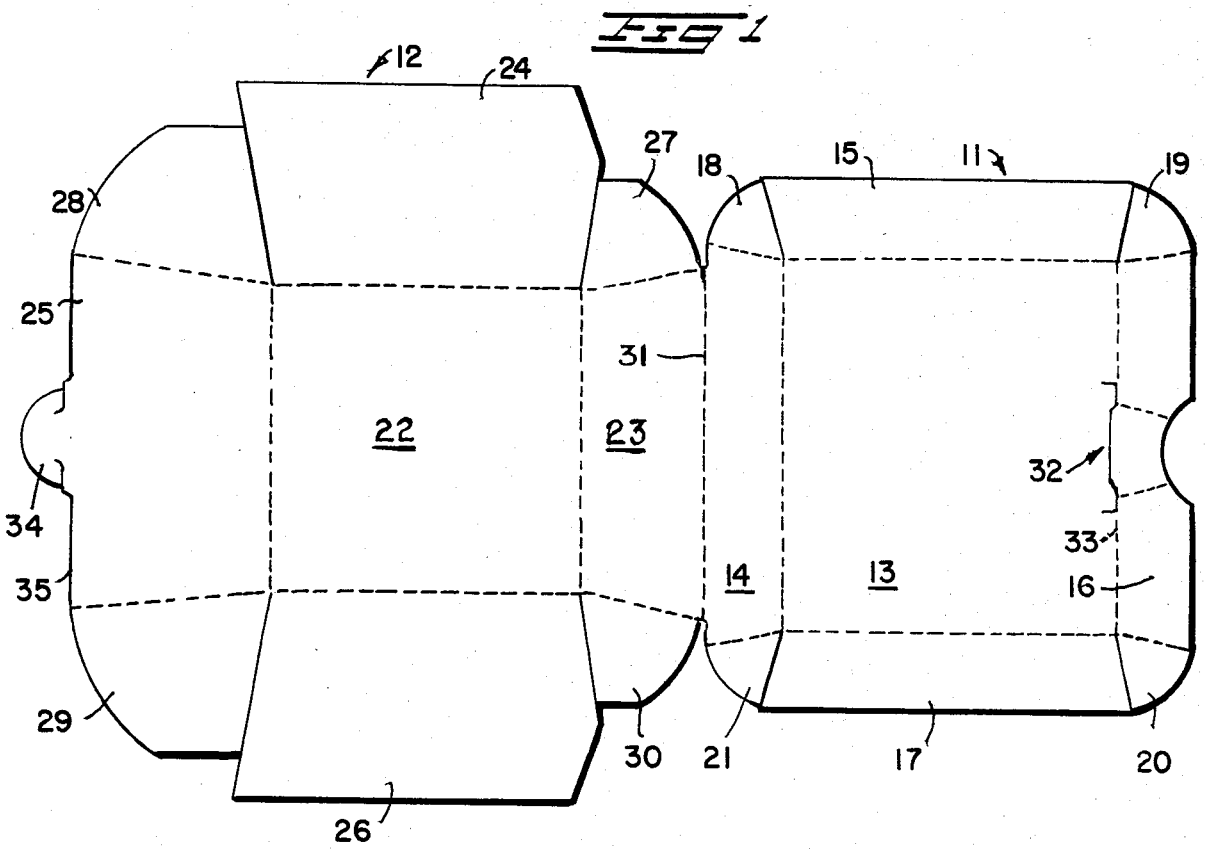
FIG. 1 is a plan view of a cut and scored paperboard blank for forming a carton according to one embodiment of the present invention.
Figure 4:
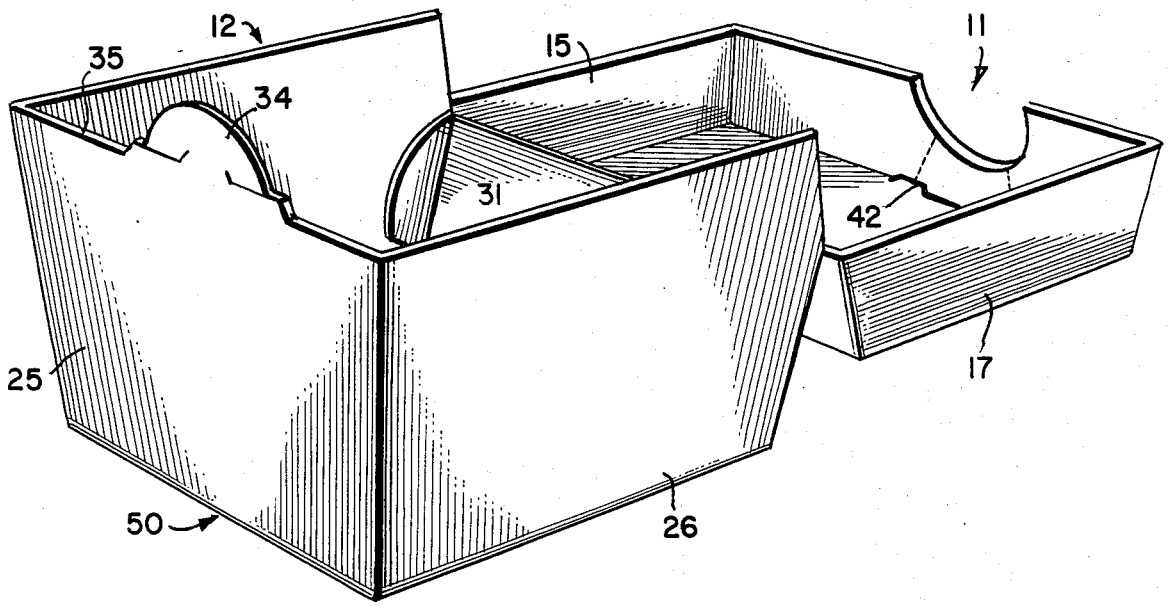
FIG. 4 is a perspective view showing the blank of FIG. 1 set up as a carton ready for loading.

In one embodiment of the present invention, the carton is prepared from a single blank of paperboard 10 as shown in FIG. 1. Blank 10 is adapted to form a cover component 11 and a tray component 12, each in the shape of a truncated pyramid as shown in FIG. 4. The cover component 11 comprises a central top panel 13 with opposed side walls 14,15,16 and 17 foldably connected thereto. Each side wall panel is in the general shape of a trapezoid with the minor base portion thereof connected to the central top panel 13 along fold lines. Each of the side walls also have glue tabs or the like 18,19,20 and 21 foldably attached thereto which may be connected to an adjacent side wall to provide a cover 11 in the shape of a truncated pyramid.

In like fashion, the tray component 12 comprises a central bottom panel 22 with opposed side walls 23,24,25 and 26 foldably connected thereto. Each tray component side wall is of generally trapezoidal shape with the minor base portion connected to the bottom panel 22 along fold lines. Each of the side walls also include glue tabs or the like 27,28,29 and 30 foldably attached to the ends thereof which may be adhered to adjacent side walls to produce a tray component in the general shape of a truncated pyramid. The lid component 11 is connected to the tray component 12 along a fold line 31 between the side walls 14,23. Thus, the side walls 14,23 form the rear walls of the carton, and side walls 16,25 form the front walls of the carton. In actual practice, the blanks are partly set up and glued as shown in FIG. 4 so that they can be shipped in a nested condition as a joined tray and lid.

A novel latching structure is provided for locking the lid 11 to the tray 12 when the carton is loaded and closed. For this purpose, a locking slot 32 is provided in a location generally along the score line 33 connecting the lid top panel 13 to the front wall 16. In addition, a locking tongue element 34 is provided along the top edge 35 of tray front wall 25 as an integral extension of the front wall. The details of these locking elements are more fully disclosed in FIGS. 2 and 3.

Figure 2:
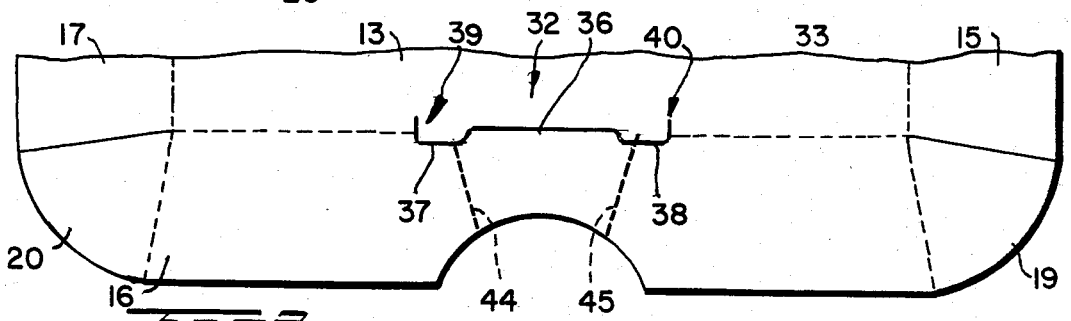
FIG. 2 is an enlarged plan view of a portion of the blank of FIG. 1 showing the details of the locking slot of the present invention.

Note in FIG. 2 that the locking slot 32 is in the form of a continuous cut line located generally along the score line 33 connecting lid top panel 13 to front wall 16. The cut line comprises a central segment 36 located in the top panel 13 and offset from the fold line 33 by an amount equal to about 1/16 inch. Beyond the ends of the central segment 36, the cut line crosses the score line 33 in a symmetrical manner and extends generally parallel to the score line 33 to form segments 37,38 in the front wall 16. Finally the cut line extends back across the score line 33 at a generally right angle thereto to terminal ends 39,40. The segments 37,38 of the locking slot 32 are offset from the fold line 33 into the front wall 16 by an amount equal to about 1/16 inch. The offset orientation of the locking slot segments 36,37 and 38 from score line 33 produces two elements which are vital to the automatic locking feature of the present invention. First, the portion of the top panel 13 removed by central segment 36 provides an upwardly extending tab 41 when the lid is formed that helps guide the locking tongue 34 into the slot 32, and the portions of the front wall 16 removed by the outer segments 37,38 provide locking tabs 42,43 which engage and restrain the locking tongue 34 when it is inserted in slot 32. Finally, both FIG. 1 and FIG. 2 show a typical means for unlocking the closed latch structure of the present invention. For this purpose, the front wall 16 of lid 11 may be applied with a pair of perforated lines 44,45 which permits the user of the carton to remove a portion of the front wall in the region of the central segment 36 of slot 32 to effectively release the locking tongue 34 from slot 32.

Figure 3:
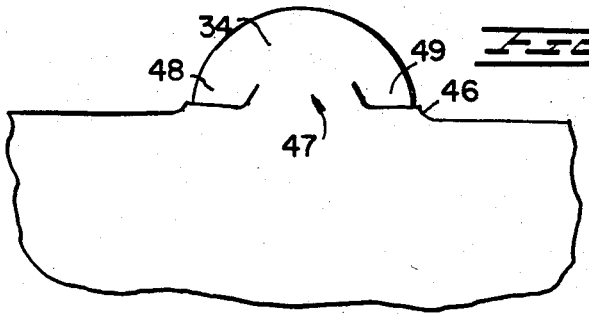
FIG. 3 is an enlarged plan view of a portion of the blank of FIG. 1 showing the details of the locking tongue element of the present invention.

FIG. 3 illustrates the details of construction of the preferred locking tongue of the present invention. Unlike the locking tongues used in the past, the tongue element 34 of the present invention extends upwardly from the tray front wall 25 in the same plane as an integral extension thereof. The extension of front wall 25 includes a first shoulder portion 46 of greater width than the tongue element 34 and a second portion comprising a locking post 47 of less width than both the first shoulder portion 46 and the tongue element 34 located symmetrically with respect to both the first shoulder portion 45 and tongue element 34. Each of these elements comprise working parts of the tongue element 34 whihch includes a leading edge that tapers rearwardly to a pair of shoulder elements 48,49, which are formed from the carton material located between the locking post 47 and the first shoulder portion 46. The height of the first shoulder portion 46 above the upper edge 35 of front wall 25 must be on the order of about 1/16 inch for most effective operation of the locking elements. Meanwhile, the locking post 47 is created when the shoulder elements 48,49 are cut from the material used to form locking tongue 34. The locking tongue 34 may take any desired shape as long as the shape is compatible with the locking slot 32. The primary function of the shoulder portion 46 is to engage the tabs 42,43 of lid component 11 when the carton is closed and raise them to a height to insure that they engage and wedge the shoulder elements 48,49 outside the area of the locking slot 32. This effect is shown in more detail in FIGS. 6(A) and 13.

FIG. 4 illustrates the formed carton 50 ready for filling. In this condition, it will be noted that the locking tongue 34 extends in an upright condition from the edge 35 of tray front wall 25 in the same general plane as front wall 25. This orientation of the locking tongue makes it readily available for its automatic self locking function when the lid 11 is folded over about score line 31 to close the carton.

Figure 5:
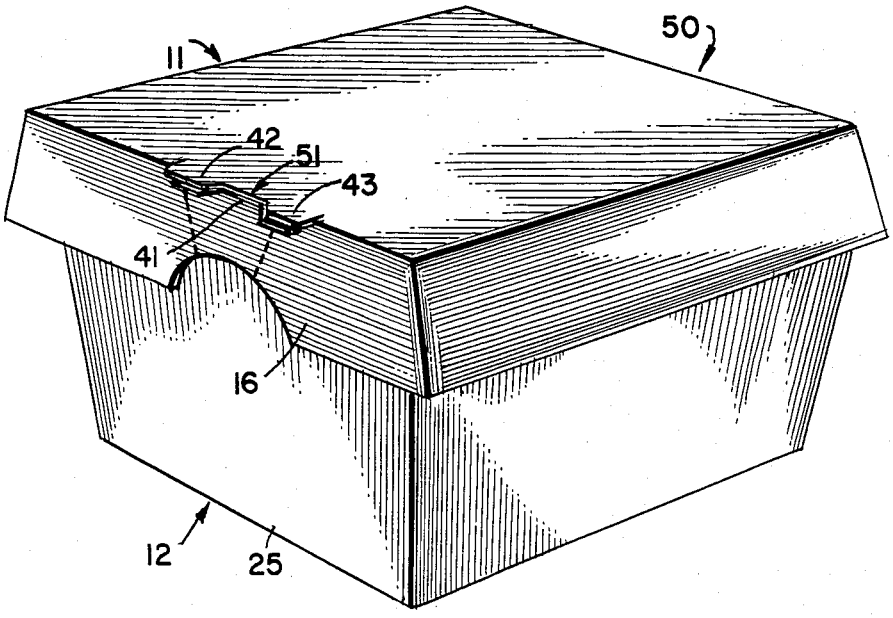
FIG. 5 is a perspective view of the carton of FIG. 4 in a partially closed condition.
Figure 6:
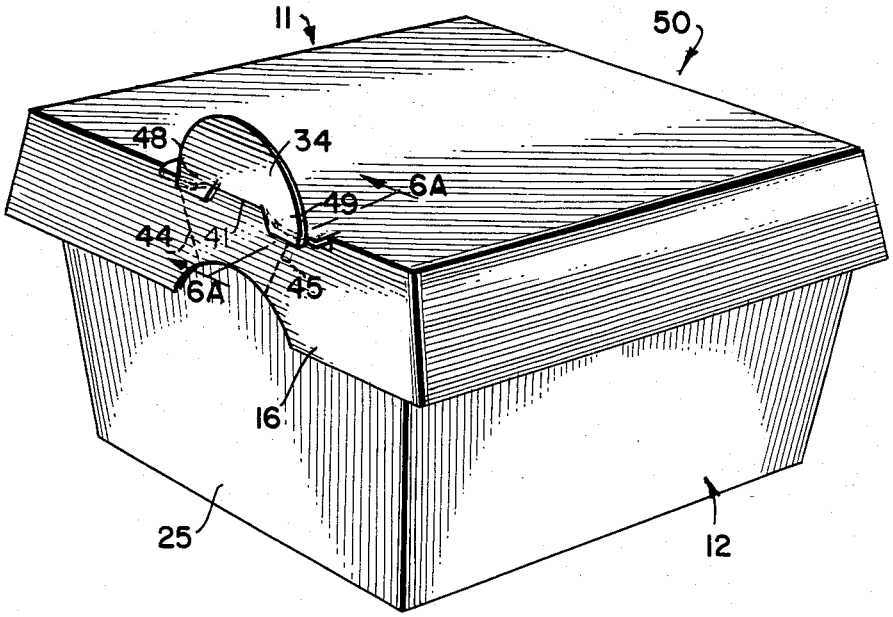
FIG. 6 illustrates the carton fully closed.
Figure 6A:
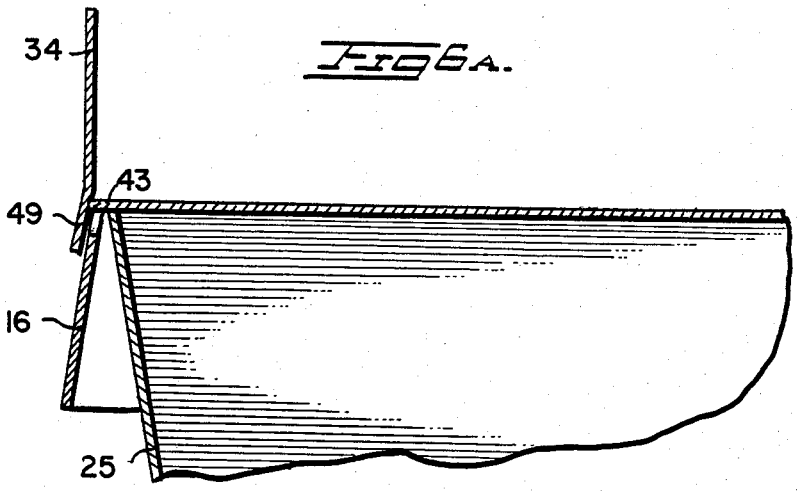
FIG. 6(A) is a partial cross section taken along the lines 6A—6A of FIG. 6 showing details of the locking elements.
Figure 7:
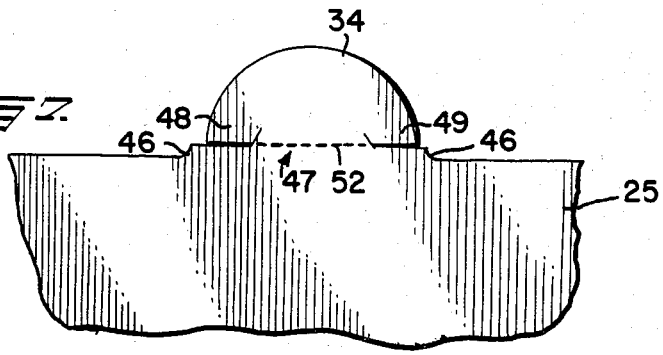
FIG. 7 is a front view of a modified locking tongue element for the carton of the present invention.

FIG. 5 shows the carton 50 partially closed. Since the lid component 11 extends over the tray component 12, an inside/outside locking arrangement is created unlike the more conventional locking schemes where the locking tab is often inserted within a locking slot to produce an outside/inside lock. Thus, as the lid 11 is folded downwardly, the upwardly extending tab 41 cut from top panel 13 acts as an extension of front wall 16 and tends to guide the tongue element (hidden from view in FIG. 5) into the locking slot 32. In addition, the outwardly inclined orientation of the front walls 16 and 25 also serve as a guide for the locking elements 32,34. When the tongue element 34 first contacts slot 32, its leading edge easily enters the slot 32 via the opening 51 in top panel 13 created by cutting the tab 41 therefrom. Subsequently, as the lid 11 is folded further in a downward direction, the shoulder portions 48,49 of tongue 34 engage the locking tabs 42,43 cut from front wall 16 to create pressure points at the ends of tabs 42,43. The tabs 42,43 of locking slot 32 urge or deflect the shoulder portions 48,49 of tongue 34 in an outward direction until such time that the tabs 42,43 come in contact with the shoulder portion 46 of tongue 34 and front wall 35. At this point, the tabs 42,43 serve as stops to keep the shoulder portions 48,49 of tongue element 34 wedged outside of the area of the slot 32 as shown in FIG. 6, so that any attempt to open the carton is thwarted by the automatic engagement of locking tabs 42,43 with shoulder elements 48,49 (see FIG. 13). The carton can be opened, of course, with the use of two hands wherein the shoulder portions 48,49 are guided individually past the tabs 42,43, but such a technique is painstaking and time consuming. Accordingly, to provide a useful means for opening the carton when desired, the present invention contemplates at least one of two possibilities. First, as shown in FIGS. 1–6, the front wall 16 of top or lid 11 may be provided with one or more perforated lines 44,45 so that a portion of the front wall can be removed in the vicinity of the locking slot 32 to effectively free the locking tabs 42,43 from the shoulder elements 48,49 of tongue element 34. Alternatively, as shown in FIG. 7, the locking tab 34 may include a perforated line 52 so that it may be physically removed to open the carton. In this case, the perforated line 52 would preferably be located above the shoulder portion 46 of front wall 25 at the top of locking post 47. However, other similar methods known to those skilled in the art and within the contemplation of the present invention could be employed for the same purpose.

Figure 8:
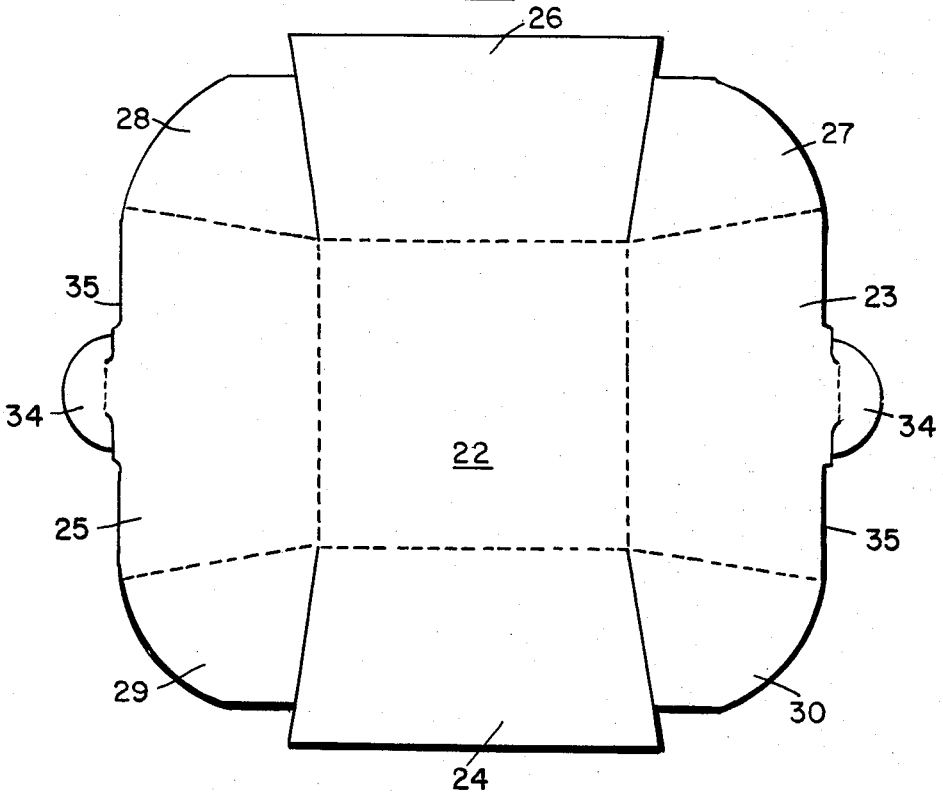
FIG. 8 is a plan view of a cut and scored paperboard blank useful for making a carton tray component according to a second embodiment of the present invention.
Figure 9:
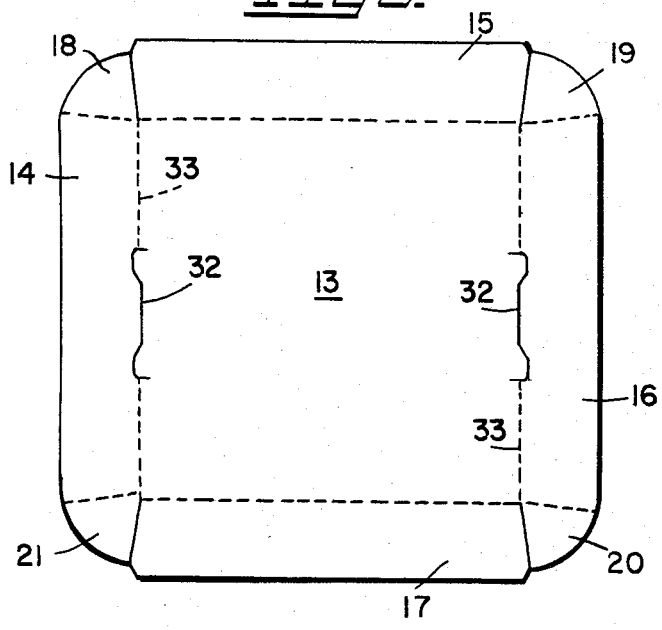
FIG. 9 is a plan view of a cut and scored paperboard blank useful for making a carton lid component according to a second embodiment of the present invention.

FIGS. 8 and 9 illustrate blank structures for manufacturing a carton according to the present invention having separate lid and tray components. In this instance, like elements disclosed in FIGS. 1–7 are given the same reference characters.

The tray blank shown in FIG. 8 comprises bottom panel 22 with opposed side walls 23,24,25 and 26 foldably connected thereto. Each side wall is of generally trapezoidal shape with the inner base portion thereof connected to the bottom panel 22 along the prescribed fold lines. The side walls each have a corner closing glue flap 27,28,29 and 30 foldably attached to one edge thereof. The two opposed side walls 23,25 each contain an integral locking tongue element 34 of the same specific shape more fully disclosed in FIG. 3.

The lid blank shown in FIG. 9 comprises a central top panel 13 with opposed side walls 14,15,16 and 17 foldably connected thereto. Each side wall is of generally trapezoidal shape with the inner base portion thereof foldably attached to the top panel 13. The side walls each have corner closing glue flaps 18,19,20 and 21 foldably attached to one edge thereof, and the opposite side walls 14 and 16 each have locking slots 32,32 formed therein along the score lines 33,33. The locking slots 32,32 in FIG. 9 correspond in all respects to the locking slot more fully disclosed in FIG. 2.

Figures 10, 11, 12, 13:
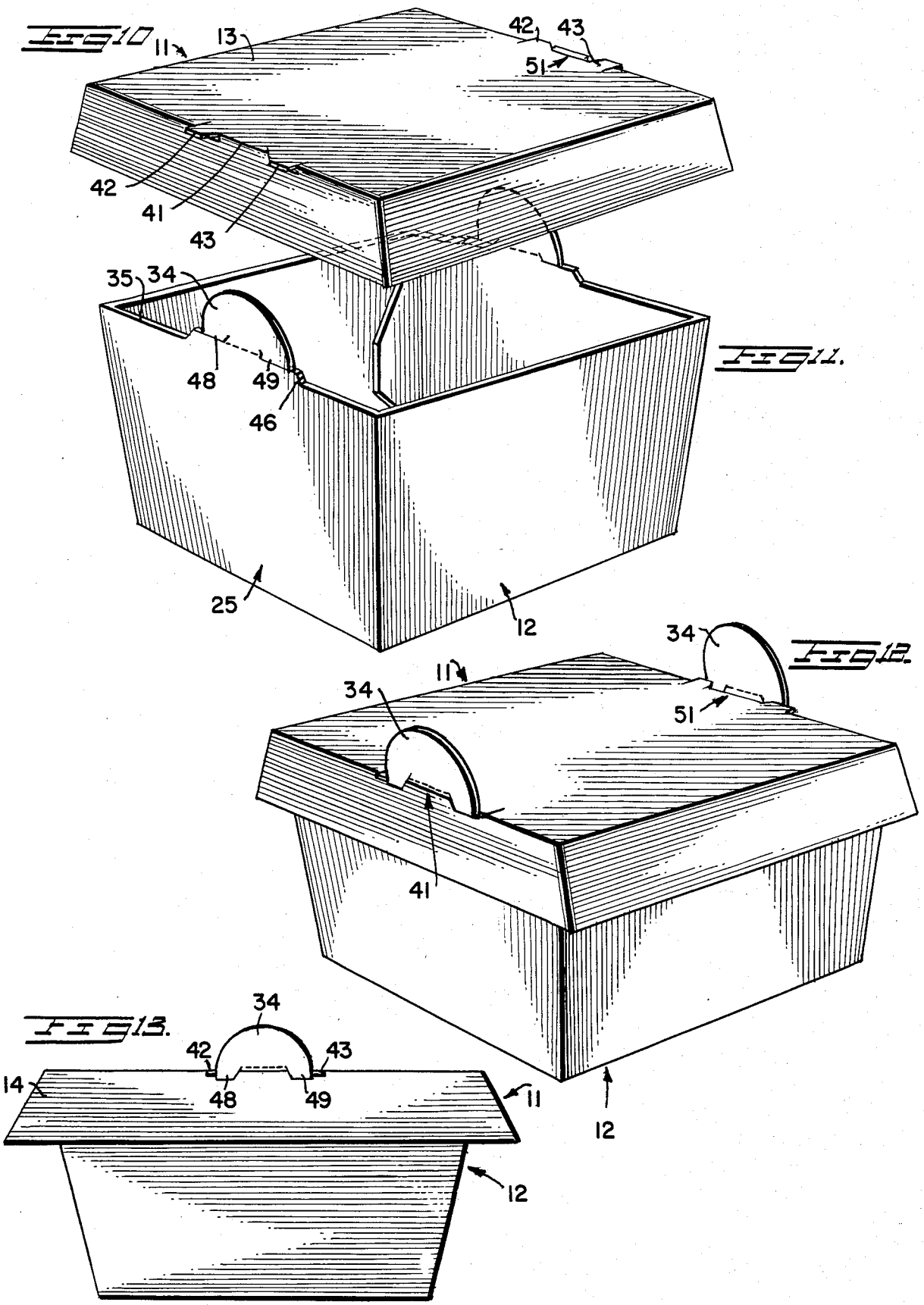
FIG. 10 is a perspective view showing the lid component blank of FIG. 8 set up and ready for closing the filled carton.
FIG. 11 is a perspective view showing the tray component blank of FIG. 9 set up and ready for filling.
FIG. 12 illustrates the two component carton fully closed.
FIG. 13 is a front view of a closed carton showing the position of the locking elements when an attempt is made to open the carton without effecting a release of the locking elements.

FIG. 11 illustrates the fully formed tray component 12 prepared from the blank of FIG. 8 in the general shape of a truncated pyramid. The upwardly and outwardly sloping side walls of the tray 21 provide a convenient shape for filling and permit the trays to be readily stacked when empty for use. The locking tongue elements 34,34 on each side wall 23,25 each extend upwardly from the upper edges 35,35 of the side walls as integral extensions thereof and in the same general planes as the side walls ready to perform their automatic locking function. Meanwhile, the fully formed lid component 11 shown in FIG. 10 also assumes the general shape of a truncated pyramid for convenient stacking and use. In addition, the downwardly and outwardly sloping side walls serve as guides for bringing the locking tongue elements 34,34 of the tray component into engagement with the locking slots 32,32 of the lid component.

FIG. 12 shows the two components 11,12 in their closed condition where the latching elements become fully and automatically engaged. Toward this end, the tongue elements 34,34 are partially guided toward the locking slots 32,32 by the general shape and orientation of the side walls 14 and 16. When the tongues 34,34 meet the slots 32,32 the leading edges thereof are further guided into the slots 32,32 because of the presence of the tabs 41 and openings 51 created by cutting the tabs from the top panel 13. When the side walls 14,16 are folded downwardly to form the lid component 11, the tabs 41 remain generally in the plane of the side walls 14,16 and create the openings 51 in the top panel 13 to permit entry of the tongues 34,34 into slots 32,32. As the lid component 11 is pushed further downward over the tray component 12, the shoulder portions 48,49 of each tongue 34 are deflected by the locking tabs 42,43 of each locking slot 32 until such time that the lid is fully closed and the top panel 13 comes to rest on the upper edges 35 of the side walls of tray component 12. In this condition, the shoulder portions 46 of each side wall 23,25 urge the locking tabs 42,43 in an upward condition to keep the shoulder portions 48,49 of tongues 34 wedged outside the normally open area of the slots 32,32. Thus any attempt to open the carton is prevented because the locking tabs 42,43 keep the shoulder portions 48,49 from passing freely back through the locking slots. When the lid is lifted, the shoulder portions 48,49 are simply wedged outside the locking slots 32 and beyond the plane of the side walls 14 and 16 by the locking tabs 42,43. FIG. 13 illustrates what happens to the shoulder elements 48,49 of each locking tab 34 when the lid is lifted. Thus, the locking tongue 34 of the present invention remains in plain view above the lid 11 until such time that it is removed by tearing along perforated line 52, or until the portion of the side wall between perforated lines 44,45 is removed.

Each embodiment of the invention disclosed herein illustrates a positive friction lock between two carton components which is effected automatically and without secondary manipulation. The locking tongues remain ready and in position for use at all times. No deformation of either the locking tongues or the locking slots is required to achieve the automatic locking function. Moreover, the locking tongues in each embodiment do not present any interference with the normal nesting of such cartons. As illustrated, the locking elements of the present invention may be utilized on cartons which consist of one or two separate components, and the various side walls of the components may be designed to afford good ventilation to the contents, particularly when packaging hot foods. If desired, more than one locking tongue may be provided on the same panel of any given carton. For instance, where the carton is used to package an elongated product, two locking means may be desired to positively close the carton. Thus while only two embodiments of the invention are shown and fully disclosed, it will be apparent to those skilled in the art that the invention may be incorporated in other modified forms equally within the scope of the appended claims.

I claim:

1. A carton with an automatic locking closure means comprising:

(a) A tray member including side walls extending upwardly from a bottom panel about score lines;

(b) a lid member including side walls extending downwardly from a top panel about score lines;

(c) at least one male locking element connected to and extending upwardly from the upper edge of one of the side walls of the tray member in the same general plane of the side wall as an integral extension thereof, said locking element including a first shoulder portion which extends above the top edge of the side wall, a locking post integral with said shoulder portion which extends above the shoulder portion, and a tongue member integral with said locking post which extends above the locking post, said shoulder portion having a greater width than both said locking post and tongue member and said tongue member having a greater width than said locking post, said tongue member including a leading edge which tapers rearwardly to a pair of opposed shoulders which are formed from the material between said locking post and said first shoulder portion;

(d) at least one cooperating female locking slot located generally along the score line connecting the lid top panel to an adjacent side wall, said slot being in the form of a continuous cut line comprising a central segment located in the top panel portion of the lid closely adjacent to said score line and at the ends of said central segment a pair of terminal segments located partly in the top panel and partly in the adjacent side wall to provide locking tabs which automatically engage the locking shoulders of said tongue element when the lid and tray are brought together to form the carton.

2. The carton of claim 1 wherein the central segment of said locking slot provides an upstanding portion of the adjacent side wall which engages the tongue member to guide it into the locking slot.

3. The carton of claim 2 wherein the outer edges of said first shoulder portion extend through the locking slot at its terminal segments thereby wedging the locking tabs of said locking slot beneath the shoulders of said tongue member to produce the automatic locking engagement of said tongue member with said locking slot.

4. The carton of claim 3 wherein the side walls of both said tray member and lid member taper outwardly to provide a guide for orienting the engagement of said tongue member with said locking slot.

5. The carton of claim 4 wherein means is provided for releasing the locking engagement of said tongue member and locking slot for opening said carton.

6. The carton of claim 5 wherein the release means comprises a perforated line on the tongue member in the region of said locking post which permits said tongue member to be removed for opening the carton.

7. The carton of claim 5 wherein the release means comprises a pair of perforated lines in the adjacent side wall of said lid member located beneath said tongue member and separated from one another by a distance substantially equal to the nominal width of said locking post which permits the removal of a portion of the side wall in the vicinity of the locking slot to release the tongue member for opening the carton.

8. The carton of claim 5 wherein the lid member and tray member are cut and scored from a single blank of paperboard or the like.

9. The carton of claim 5 wherein the lid member and tray member are cut and scored from separate blanks of paperboard.

10. A carton with an automatic locking closure means cut and scored from a blank of paperboard or the like comprising a tray component including side, front and rear walls each having the shape of a trapezoid foldably attached to a central bottom panel along the minor base portions thereof and a lid component including side, front and rear walls each having the shape of a trapezoid foldably attached to a central top panel along the minor base portions thereof, glue flaps foldably attached to an edge of each side, front and rear wall and adhered to an adjacent side, front or rear wall to form tray and lid components of generally truncated pyramid configurations, said tray and lid components being joined along a fold line common to their rear walls, said locking means further comprising:

(a) at least one male locking element extending upwardly from the top edge of the front wall of the tray member in the same general plane of the front wall as an integral extension thereof, said locking element including a first shoulder portion which extends above the top edge of said front wall, a locking post integral with said shoulder portion which extends above the shoulder portion, and a tongue member integral with said locking post which extends above the locking post, said shoulder portion having a greater width than both said locking post and tongue member and said tongue member having a greater width than said locking post, said tongue member including a leading edge which tapers rearwardly to a pair of opposed shoulders which are formed from the carton material located between said locking post and said first shoulder portion; and, (b) at least one cooperating female locking slot located generally along the score line connecting the lid top panel to its front wall, said slot being in the form of a continuous cut line comprising a central segment lying in the top panel portion of the lid closely adjacent to said score line and a pair of terminal segments lying partly in the top panel and partly in the front wall to produce a tongue receiving slot area formed partially in the top panel and partially in the front wall when the lid component is formed, wherein the central segment provides an upstanding portion of the front wall for guiding the tongue member into that part of the slot area formed in the top panel, and said terminal segments provide locking tabs formed from the front wall which wedge the shoulder portions of the tongue member through those portions of the slot area formed in the front wall to provide an effective, automatic locking engagement of the tongue and slot when the tongue member is fully inserted in the locking slot.

11. The carton of claim 10 including means for opening the carton, said means comprising a pair of spaced perforated lines in the front wall of the lid component located beneath the locking slot whereby a portion of the front wall may be removed to release the locking elements.

12. A carton with an automatic locking closure means comprising a tray component cut and scored from a blank of paperboard or the like, said tray component including a plurality of side walls each having the shape of a trapezoid foldably attached to a central bottom panel along the minor base portions thereof and a lid component cut and scored from a blank of paperboard or the like, said lid component including a plurality of side walls each having the shape of a trapezoid foldably attached to a central top panel along the minor base portions thereof, glue flaps foldably attached to an edge of each of the side walls of each component and adhered to an adjacent side wall to form components of generally truncated pyramid configuration, said locking means further comprising:

(a) at least one pair of male locking elements extending upwardly from the top edge of two opposed side walls of said tray component in the same general planes as the side walls as integral extensions thereof, said locking elements including first shoulder portions which extend above the top edges of each side wall by a nominal amount, locking posts integral with each shoulder portion which extend above the shoulder portions, and tongue members integral with each locking post which extend above the locking posts, said shoulder portions having a greater width than both said locking posts and said tongue members, and said tongue members having a greater width than said locking posts, said tongue members each including a leading edge which tapers rearwardly to a pair of opposed shoulders which are formed from the carton material located between said locking post and said first shoulder portion; and, (b) at least one pair of cooperating female locking slots located generally along the score lines connecting the top panel to two opposed side walls of said lid component, said slots being in the form of continuous cut lines comprising central segments lying in the top panel portion of the lid closely adjacent to said score lines and pairs of terminal segments lying partly in the top panel and partly in the side walls to produce tongue receiving slot areas formed partially in the top panel and partially in the side walls when the lid component is formed, wherein the central segments provide upstanding portions of the side walls for guiding the tongue members into those parts of the slot areas formed in the top panel, and said paired terminal segments provide locking tabs formed from the side walls which wedge the shoulder portions of the tongue members through those portions of the slot areas formed in the side walls to provide an effective, automatic locking engagement of the tongues and slots when the tongue members are fully inserted in the locking slots.

13. The carton of claim 12 including means for opening the carton, said means comprising perforated lines in each tongue member in the region of the locking posts whereby the tongue members may be removed to release the locking elements.

* * * * *